US005829247A

United States Patent [19]

Zhang

[11] Patent Number: 5,829,247

[45] Date of Patent: Nov. 3, 1998

[54] CONTROL SYSTEM FOR A COMBUSTION ENGINE

[75] Inventor: Hong Zhang, Regensburg, Germany

[73] Assignee: Robert Bosch GmbH, Stuttgart, Germany

[21] Appl. No.: 718,331

[22] PCT Filed: Apr. 27, 1995

[86] PCT No.: PCT/DE95/00564

§ 371 Date: Sep. 25, 1996

§ 102(e) Date: Sep. 25, 1996

[87] PCT Pub. No.: WO95/30827

PCT Pub. Date: Nov. 16, 1995

[30] Foreign Application Priority Data

May 6, 1994 [DE] Germany ..... 44 15 994.3

[51] Int. Cl.[6] ..... F02D 41/14; F02D 37/02

[52] U.S. Cl. ..... 60/285; 123/478; 123/676

[58] Field of Search ..... 60/276, 277, 285; 123/406, 417, 425, 435, 478, 480, 676

[56] References Cited

U.S. PATENT DOCUMENTS

| | | | |
|---|---|---|---|
| 4,716,873 | 1/1988 | Takaba et al. | 123/425 |
| 4,825,836 | 5/1989 | Hirose | 123/478 |
| 5,027,773 | 7/1991 | Shimomura et al. | 123/425 |
| 5,107,815 | 4/1992 | Van Duyne | 123/435 |
| 5,156,126 | 10/1992 | Ohkubo et al. | 123/425 |

OTHER PUBLICATIONS

"Patent Abstracts of Japan", vol. 15, No. 457 (M–1181), abstract of JP–3–194153, Nov. 1991.

*Primary Examiner*—Tony M. Argenbright
*Attorney, Agent, or Firm*—Kenyon & Kenyon

[57] ABSTRACT

A control system for a combustion engine enriches the air-fuel mixture supplied to the combustion engine when a signal indicating the efficiency of the combustion engine either directly or indirectly drops below a threshold value. This enrichment prevents the exhaust gas temperature, which increases as the efficiency of the combustion engine drops, from reaching such a high level that there is damage to the exhaust valves or the exhaust system, especially the exhaust gas catalyst.

11 Claims, 3 Drawing Sheets

CONTROL SYSTEM FOR A COMBUSTION ENGINE

BACKGROUND INFORMATION

This invention relates to a control system for a combustion engine.

In controlling a combustion engine it may sometimes be necessary to shift the ignition angle from the normal position in the direction of retarding it. Such a shift in ignition angle may be considered, for example, in conjunction with methods for reducing or preventing knocking during combustion or methods of reducing drive slip. As a rule, however, the exhaust gas temperature increases when the ignition angle is retarded. If the exhaust gas temperature is too high, it may damage the exhaust valves or the exhaust system, especially the exhaust gas catalyst. To prevent an unacceptably high exhaust gas temperature with the known control systems, the air-fuel mixture supplied to the combustion engine is enriched whenever the ignition angle exceeds a certain threshold value. The degree of enrichment is usually set as a function of the extent to which the threshold value is exceeded.

German Patent Application No. DE 41 03 419 A1 describes a control system for a combustion engine in which the air-fuel mixture is enriched when a signal indicating the efficiency of the engine drops below a threshold value. The efficiency is determined on the basis of the cylinder pressure. The exhaust gas temperature has no effect on the calculated efficiency.

An object of the invention is to prevent the exhaust gas temperature from rising to an unacceptable level.

SUMMARY OF THE INVENTION

The advantage of this invention is that components in thermal contact with the exhaust gas can be protected from damage caused by overheating.

The air-fuel mixture is enriched when a signal indicating the efficiency of the combustion engine either directly or indirectly is below a threshold value, the air-fuel mixture is enriched. It is especially advantageous here that the degree of enrichment is based very accurately on the actual requirements, thus preventing an over-rich mixture. This has an especially advantageous effect on the consumption and exhaust balance of the combustion engine.

An especially great reliability of this invention can also be achieved specifically by enriching the air-fuel mixture only when one or more secondary conditions are met. Secondary conditions include, for example, the elapse of an interval since the signal indicating efficiency drops below the threshold value or after the threshold value for the exhaust gas temperature or the catalyst temperature is exceeded.

DETAILED DESCRIPTION OF THE INVENTION

Figure 1:
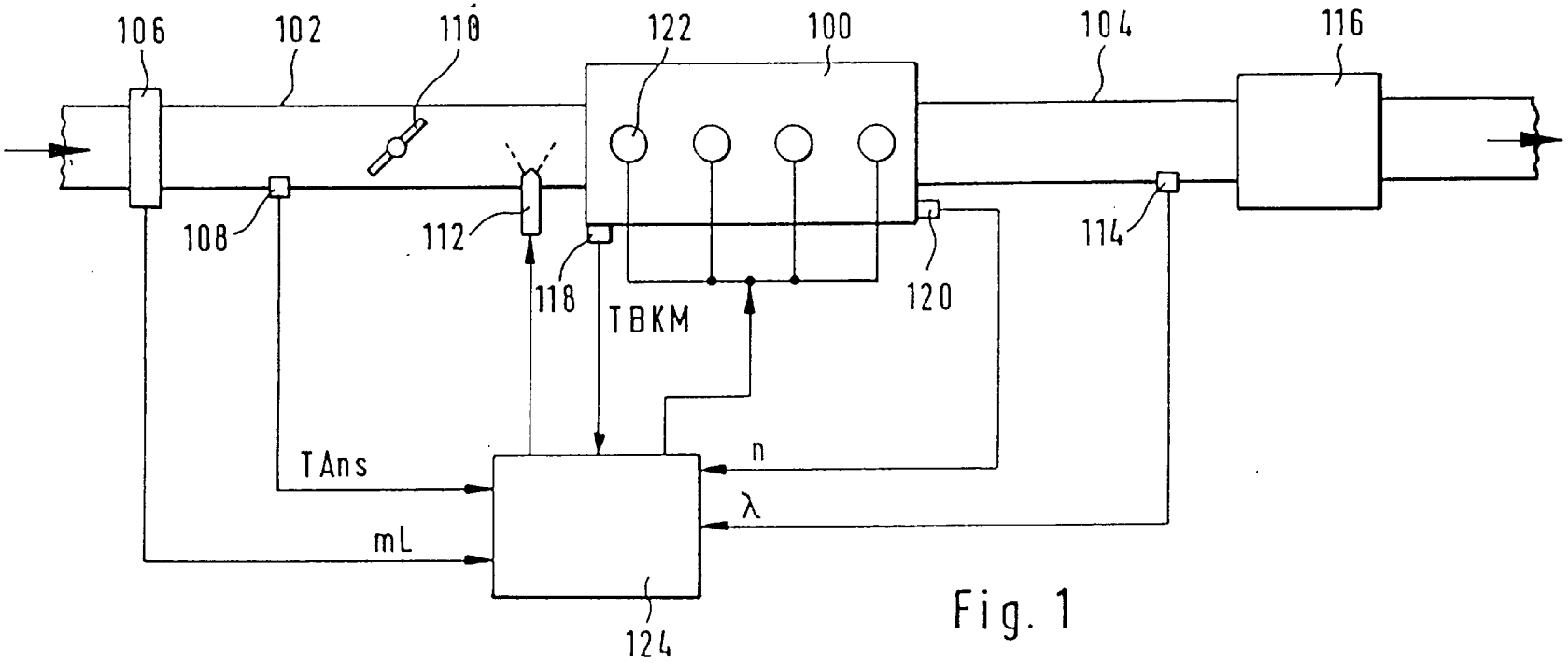
FIG. 1 shows a control system for a combustion engine.

FIG. 1 shows a control system for a combustion engine in accordance with the present invention. A combustion engine 100 is supplied with an air-fuel mixture through an intake duct 102 and the exhaust gases are delivered to an exhaust channel 104. Intake duct 102 contains, as seen in the direction of flow of the air intake, an air flow sensor or air mass meter 106, such as a hot-film air mass meter, a temperature sensor 108 for sensing the intake air temperature, a throttle valve 110 and at least one injection nozzle 112. Exhaust channel 104 has, as seen in the direction of flow of the exhaust gas, an exhaust gas sensor 114 and a catalyst 116. A temperature sensor 118 for detecting the temperature of the combustion engine and an engine speed sensor 120 are mounted on combustion engine 100. Combustion engine 100 also has four spark plugs 122, for example, for igniting the air-fuel mixture in the cylinders.

The output signals mL of the air mass meter or air flow sensor 106, TAns of temperature sensor 108, $\lambda$ of exhaust gas sensor 114, TBKM of temperature sensor 118 and n of engine speed sensor 120 are sent to a central control unit 124 over appropriate connecting lines. Control unit 124 analyzes the sensor signals and controls injection nozzle(s) 112 and spark plugs 122 via additional connecting lines.

Figure 2:
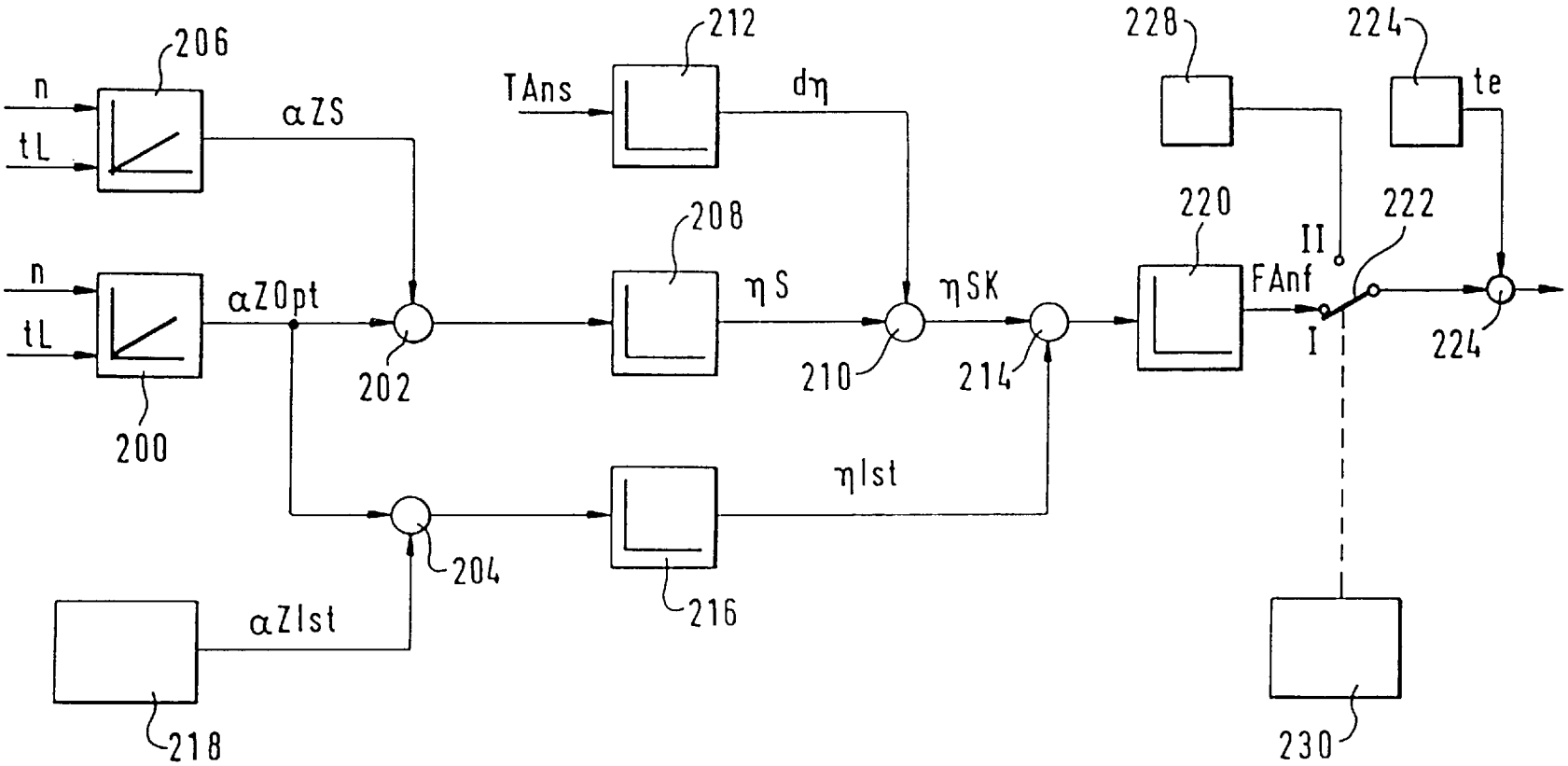
FIG. 2 shows a circuit for controlling the enrichment of the air-fuel mixture in the combustion engine.

FIG. 2 shows a circuit for controlling the enrichment of the air-fuel mixture in combustion engine 100. A signal for the optimum ignition angle $\alpha$ZOpt is determined with the help of an engine characteristic map 200 into which are entered a signal for the speed n of combustion engine 100 and a signal for the load tL. The signal for the speed n is generated by speed sensor 120. The signal for the load tL is determined from the output signal mL of the air mass meter or air flow sensor 106. The signal for the optimum ignition angle $\alpha$ZOpt is fed to a first input of a node 202 and a first input of another node 204. A signal for an ignition angle threshold value $\alpha$ZS that is supplied by engine characteristic map 206 is sent to the second input of node 202. Engine characteristic map 206 has two inputs which receive the signal for the speed n of combustion engine 100 and the signal for the load tL. Node 202 forms the difference between the signal for the optimum ignition angle $\alpha$ZOpt and the signal for the ignition angle threshold value $\alpha$ZS and it supplies the difference at its output. The output of node 202 is connected to the input of a characteristic 208. Characteristic 208 outputs a threshold value $\eta$S for a signal that indicates the efficiency of combustion engine 100 either directly or indirectly. Threshold value $\eta$S is sent to a first input of a node 210. The second input of node 210 is connected to the output of a characteristic 212 whose input receives the signal for the intake air temperature TAns. The signal TAns is delivered by temperature sensor 108. Characteristic 212 determines a correction value d$\eta$ for threshold value $\eta$S as a function of intake air temperature TAns. Node 210 adds threshold value $\eta$S and correction value d$\eta$ and supplies the corrected threshold value $\eta$SK obtained in this way at its output. The output of node 210 is connected to a first input of a node 214. An actual value $\eta$Ist of the signal indicating the efficiency is supplied to the second input of node 214. This actual value $\eta$Ist is output by a characteristic 216 whose input is connected to the output of node 204. The signal for the optimum ignition angle $\alpha$zOpt is supplied to the first input of node 204 and the signal for the actual ignition angle $\alpha$ZIst, which is output by a block 218, is supplied to the second input.

The output of node 214 that receives the difference between the actual value $\eta$Ist and the corrected threshold value $\eta$SK is connected to the input of a characteristic 220. Characteristic 220 outputs an enrichment factor FAnf for the air-fuel ratio depending on this difference. This enrichment factor FAnf can be relayed to a first input of a node 224 via a switch 222. A signal for the injection time te is supplied to the second input of node 224. This signal te is multiplied by the enrichment factor FAnf in node 224, and finally injection nozzle(s) 112 is/are regulated with the signal supplied at the output of node 224. Switch 222 can be switched between two switch positions. In a first switch position I, switch 222 connects the output of characteristic 220 to the first input of node 224. In a second switch position II, switch 222 connects the output of a memory 228 to the first input of node 224. A fixed value for the enrichment factor FAnf, usually a value of 1, is stored in memory 228. Switch 222 is controlled by a block 230. Block 230 checks one or more conditions and controls switch 222 either to switch position I or to switch position II, depending on the outcome of this check. The conditions are designed so that unnecessary or unwanted enrichment of the air-fuel mixture is prevented. In a first condition, it is possible to inquire, for example, whether a period of time t since which the actual value ηIst has been smaller than the corrected threshold value ηSK exceeds a predetermined period t0. This condition assures that the air-fuel mixture will not be enriched when there is a brief and thus harmless loss of efficiency-for example, when the ignition angle is altered briefly. Another condition might be to inquire whether the exhaust gas temperature is higher than a given threshold value or whether the catalyst temperature is higher than a given threshold value. Only if the corresponding threshold value has been exceeded is there danger of damage to the exhaust valves, the catalyst or other components of the exhaust system. The exhaust gas temperature and/or the catalyst temperature can be measured or it can be determined with a temperature model.

The efficacy of the invention illustrated in FIG. 2 can be described as follows:

To prevent an unacceptably high exhaust gas temperature, the air-fuel mixture is optionally enriched by multiplying the injection time te in node 224 by an enrichment factor FAnf, which has a value equal to or greater than 1. To determine the injection time te, a number of methods are known from the prior art although they will not be discussed further here. It will be pointed out only that the injection time te can be provided with corrections and especially with different enrichment factors before it is sent to node 224, for example, due to cold-start enrichment or full-load enrichment. An important aspect of this invention consists of the fact that the air-fuel mixture is enriched when the actual value ηIst of the signal indicating the efficiency of combustion engine 100 drops below the corrected threshold value ηSK. This procedure is based on the finding that more thermal energy is emitted in the exhaust as the efficiency of combustion engine 100 drops. The actual value ηIst and the corrected threshold value ηSK are compared in node 214, where the difference between the two values is determined and fed into characteristic 220. As long as this difference is negative, in other words, as long as the actual value ηIst is larger than the corrected threshold value ηSK, characteristic 220 outputs an enrichment factor FAnf with a value of 1. the mixture is not enriched. However, if this difference is positive, characteristic 220 supplies an enrichment factor FAnf greater than 1. Enrichment factor FAnf can increase as a linear function of the difference, for example. Depending on the application, however, some other functional relationship between FAnf and the difference may also be used.

The values for ηIst and ηSK are determined as follows:

Corrected threshold value ηSK is determined from threshold value ηS. The purpose of preselecting threshold value ηS consists of the fact that a critical exhaust gas temperature or catalyst temperature which can cause damage if exceeded is reached precisely when the actual value ηIst is equal to threshold value ηS at a given intake air temperature TAns. With the help of engine characteristic map 208, threshold value ηS is determined as a function of the difference between the signal for the optimum ignition angle αZOpt and a signal for ignition angle threshold value αZS. Optimum ignition angle αZOpt is read from engine characteristic map 200 as a function of the load tL and the speed n, and αZS is read from engine characteristic map 206 as a function of the load tL and the speed n. The difference between αZOpt and αZS is formed in node 202.

In order to take into account the intake air temperature TAns, which also affects the exhaust gas temperature, in addition to the load and engine speed, threshold value ηS is linked with correction value ηn in node 210. Value ηn is read from characteristic 212 as a function of the intake air temperature TAns. Taking into account the intake air temperature TAns constitutes an advantageous embodiment of this invention, A further embodiment of this invention omits node 210 and characteristic.

Actual value ηIst is determined with the help of engine characteristic map 216 from the deviation of the signal for the actual ignition angle αZIst from the signal for the optimum ignition angle αZOpt. The greater the difference between these two signals, the smaller is the actual value ηIst. The difference between the signals for αZOpt and αZIst is formed in node 204. As mentioned above, the signal for αZOpt is determined from the engine characteristic map 200 as a function of the load tL and engine speed n. The signal for αZIst is supplied by block 218. The details of how block 218 generates signal αZIst do not matter for the purposes of this invention and therefore will not be discussed further here.

Figure 3A:
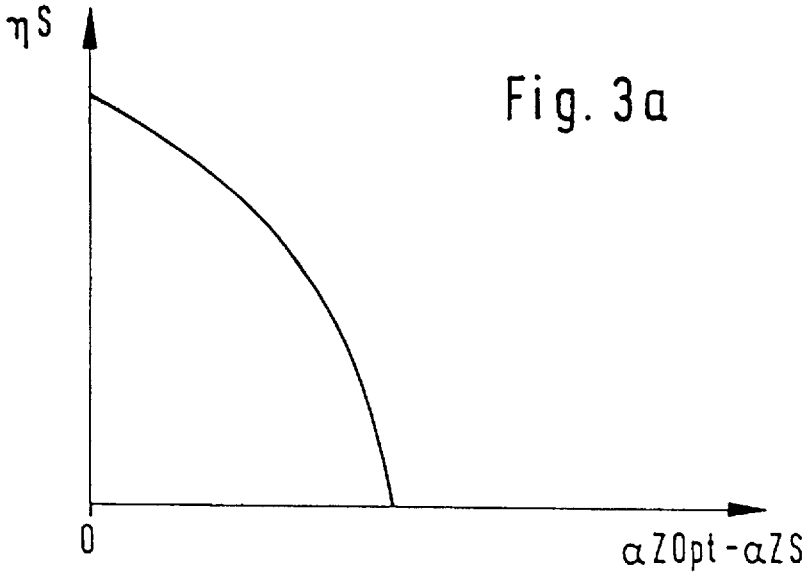
FIGS. 3*a* and 3*b* show the plots of two characteristics used in this invention.

FIG. 3*a* shows one possible curve for threshold value ηS, which is plotted against the difference between the signals for the optimum ignition angle αZOpt and the threshold ignition angle αZS. The threshold value ηS reaches a maximum when the difference is 0 and drops as the difference becomes larger.

Figure 3B:
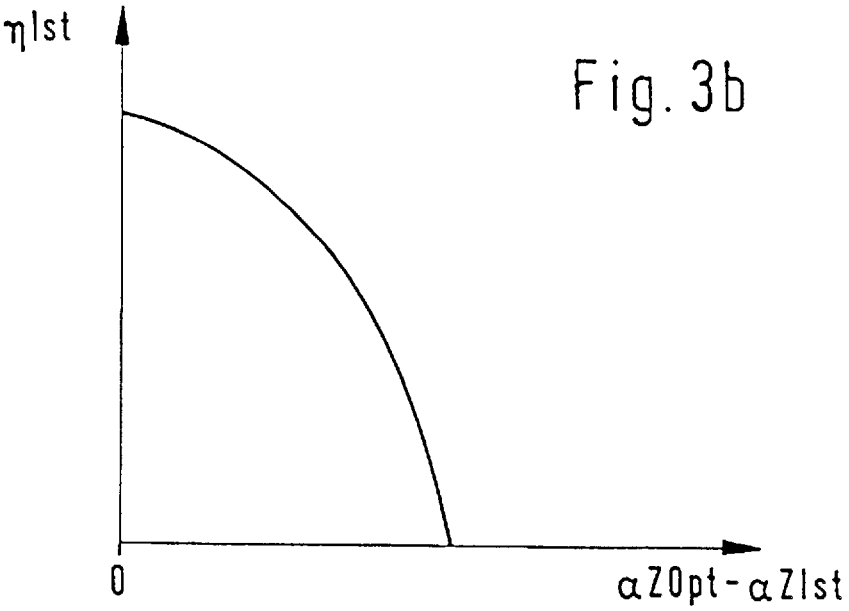

FIG. 3*b* shows a possible curve for characteristic 216, i.e., the actual value ηIst, which is plotted against the difference between the signals for the optimum ignition angle αZOpt and the actual ignition angle αZIst. If the difference is 0, the actual value ηIst is at a maximum and drops with an increase in this difference.

The text accompanying FIG. 2 describes nodes 202, 204, 210, 214 and 224, each of which links two input signals to form one output signal. The linkage is accomplished by subtraction, addition or multiplication. As a variant, linkage operations other than those described in the text accompanying FIG. 2 can also be performed in one or more nodes, and different types of linkage operations such as division may also be used. However, it should be pointed out that the signals involved in the linkage and the linkage operation must be coordinated, i.e., the stored values, characteristics and engine characteristic maps must be designed appropriately when using a different linkage operation.

In a simple embodiment, one or more of the characteristics or engine characteristic maps illustrated in FIG. 2 may be replaced by a value that can be preselected, thus reducing the effort required.

Instead of reading the enrichment factor FAnf from characteristic 220 as illustrated in FIG. 2, it can also be determined by multiplying the difference between the corrected threshold value ηSK and the actual value ηIst by a constant. If this difference is negative, the value 1 is assigned to the enrichment factor FAnf.

What is claimed is:

1. A control system for a combustion engine comprising:

means for generating a combustion engine efficiency signal;

means for generating a threshold value as a function of a difference between a signal for an optimum ignition angle and a signal for a threshold ignition angle;

means for enriching an air-fuel mixture of the combustion engine when the combustion engine efficiency signal is less than the threshold value.

2. The control system according to claim 1, wherein the enrichment of the air fuel mixture is performed on the basis of a difference between the threshold value and an actual value of the combustion engine efficiency signal.

3. The control system according to claim 2, wherein the air-fuel mixture is enriched only when the difference between the threshold value and the actual value of the combustion engine efficiency signal is positive, wherein the degree of enrichment increases as the difference between the threshold value and the actual value of the combustion engine efficiency signal increases.

4. The control system according to claim 2, wherein the air-fuel mixture is enriched only when the actual value of the combustion engine efficiency signal remains less than the threshold value for a duration that exceeds a predetermined time.

5. The control system according to claim 1, wherein the air-fuel mixture is enriched only when an exhaust gas temperature of the combustion engine is greater than a first preselected temperature.

6. The control system according to claim 1, wherein the air-fuel mixture is enriched only when a catalyst temperature of the combustion engine exceeds a second preselected temperature.

7. The control system according to claim 1, wherein the threshold value includes a correction value, the correction value depending on an intake air temperature of the combustion engine.

8. The control system according to claim 2, wherein the actual value of the combustion engine efficiency signal is determined as a function of the difference between the signal for the optimum ignition angle and a signal for an actual ignition angle.

9. The control system according to claim 1, wherein the signal for the optimum ignition angle and the signal for the threshold ignition angle are determined as a function of a load and a speed of the combustion engine.

10. The control system according to claim 1, wherein the degree of enrichment of the air-fuel mixture is determined on the basis of an enrichment factor, the enrichment factor being determined as a function of the difference between the threshold value and the actual value of the combustion engine efficiency signal.

11. The control system according to claim 10, wherein the enrichment of the air-fuel mixture is performed on the basis of the enrichment factor and an injection time.

* * * * *

UNITED STATES PATENT AND TRADEMARK OFFICE

CERTIFICATE OF CORRECTION

PATENT No. : 5,829,247

DATED : November 3, 1998

INVENTOR(S): Hong Zhang

It is certified that error appears in the above-identified patent and that said Letters Patent is hereby corrected as shown below:

Column 1, line 51, "since" should be --after--;

Column 2, line 57, "$\alpha$zOpt" should be --$\alpha$ZOpt--'

Column 3, line 55, before "the mixture" insert --Under this condition,--;

Column 4, line 15, (both occurrences)"$\eta$n" should be --d$\eta$--;

Column 4, line 19, after "invention" (first occurrence) delete ","and insert --.--.

Column 4, line 20, after "characteristic" insert --212--.

Signed and Sealed this

Fourteenth Day of September, 1999

*Attest:*

Q. TODD DICKINSON

*Attesting Officer*

*Acting Commissioner of Patents and Trademarks*